US008821169B2

(12) United States Patent
Ng

(10) Patent No.: US 8,821,169 B2
(45) Date of Patent: Sep. 2, 2014

(54) CONNECTOR

(75) Inventor: Boon Peng Ng, Singapore (SG)

(73) Assignee: Molex Incorporated, Lisle, IL (US)

( * ) Notice: Subject to any disclaimer, the term of this patent is extended or adjusted under 35 U.S.C. 154(b) by 245 days.

(21) Appl. No.: 13/538,090

(22) Filed: Jun. 29, 2012

(65) Prior Publication Data

US 2013/0178109 A1 Jul. 11, 2013

(30) Foreign Application Priority Data

Jul. 4, 2011 (CN) ..... 2011 2 0239955 U

(51) Int. Cl.
*H01R 12/00* (2006.01)
*H01R 12/72* (2011.01)
*H01R 12/70* (2011.01)

(52) U.S. Cl.
CPC ..... *H01R 12/72* (2013.01); *H01R 12/724* (2013.01); *H01R 12/7058* (2013.01)
USPC ..... 439/79; 439/629

(58) Field of Classification Search
USPC ..... 439/79, 629
See application file for complete search history.

(56) References Cited

U.S. PATENT DOCUMENTS

| | | | | |
|---|---|---|---|---|
| 4,708,415 | A * | 11/1987 | White | 439/633 |
| 4,717,218 | A * | 1/1988 | Ratcliff | 439/59 |
| 5,044,967 | A * | 9/1991 | Takano | 439/79 |
| 5,897,386 | A * | 4/1999 | Baxter et al. | 439/79 |
| 6,699,070 | B1 | 3/2004 | Wu | |
| 7,963,787 | B2 * | 6/2011 | Demonica et al. | 439/326 |

* cited by examiner

*Primary Examiner* — Tho D Ta
(74) *Attorney, Agent, or Firm* — Stephen L. Sheldon

(57) ABSTRACT

An electrical connection device comprises an electrical connector, a receiving portion, and a limiting element. The electrical connector comprises a housing, a plurality of terminals supported by the housing, and a mounting face positioned at a bottom side thereof. The receiving portion is provided to the bottom side of the electrical connector and positioned in front of the mounting face and has a receiving groove extending in a front-rear direction. The limiting element is provided through the receiving groove and positioned in the receiving portion and has an abutting-retaining face inclined to the ground and facing the mounting face. When the electrical connection device is mounted to a circuit board, the mounting face is mounted to an upper surface of a circuit board, and the abutting-retaining face abuts against a front edge of a lower surface of the circuit board.

22 Claims, 10 Drawing Sheets

CONNECTOR

RELATED APPLICATIONS

This application claims priority to Chinese Application No. 201120239955.4, filed Jul. 4, 2011, which is incorporated herein by reference in its entirety.

TECHNICAL FIELD

The present application relates to an electrical connection device, and more specifically, to an electrical connection device having a limiting element of which a position can be adjusted according to a thickness of a circuit board.

BACKGROUND ART

Generally, for an electrical connector provided at an edge of a circuit board, if a mating direction of the electrical connector is parallel to a board surface of the circuit board, an electrical connection between the electrical connector and the circuit board is easily damaged due to improper external force, for example, when a force exerted during inserting or pulling out a mating connector of the electrical connector is not parallel to the board surface of the circuit board, the electrical connector would be oscillated so that terminals of the electrical connector will be easily separated from the circuit board.

In order to have the electrical connection between the electrical connector and the circuit board reliable, for example, Taiwan Utility Model Patent publication No. 547808 (corresponding to U.S. Pat. No. 6,699,070 and China Patent CN2582195Y) discloses an electrical connector having a latching element, a circuit board is clamped by the latch element and an insulative body, that is, the circuit board is clamped between the latch element and the insulative body, which may avoid the electrical connector from oscillating when the electrical connector is subjected to an improper force exerted so as to increase reliability of electrical connection between conductive electrical terminals and the circuit board.

However, a spacing distance between the latch element and the insulative body is constant, it only can be used to clamp a circuit board which has a specified thickness matched with the spacing distance, so it is difficult to mount the electrical connector to circuit boards with different thickness specifications. In addition, there is not a lot of room for adjustments in use. When attempted to be used with the circuit board of different thickness, the connector and the latching element as whole usually require a revised or modified mold, thereby increasing the manufacturing cost.

SUMMARY OF THE INVENTION

According to a referred embodiment of the present application, an electrical connection device comprises an electrical connector, a receiving portion, and a limiting element. The electrical connector comprises an insulative housing, a plurality of terminals provided to the insulative housing, and a mounting face positioned at a bottom side thereof. The receiving portion is provided to the bottom side of the electrical connector and positioned in front of the mounting face and has a receiving groove extending in a front-rear direction. The limiting element is provided through the receiving groove and positioned in the receiving portion and has an abutting-retaining face inclined to the ground and facing the mounting face, at least a part of the abutting-retaining face protrudes out of a rear side of the receiving groove and is positioned under the mounting face. In an embodiment, when the electrical connection device is mounted to a circuit board, the mounting face is mounted to an upper board surface of the circuit board, and the abutting-retaining face abuts against a front edge of a lower board surface of the circuit board.

Preferably, the electrical connection device further comprises a positioning mechanism provided between the receiving portion and the limiting element for positioning the limiting element at different positions in the front-rear direction. Preferably, the positioning mechanism comprises at least a latching block provided to the receiving portion and a plurality of one-way latching teeth provided to the limiting element and continuously arranged, the latching block abuts against one of the latching teeth so as to position the limiting element. Preferably, the latching teeth are provided to a bottom surface of the limiting element, and the positioning mechanism further comprising at least a resilient arm provided to the receiving portion, a distal end of each of the resilient arms is provided with a latching block. Preferably, the receiving portion is integrally connected to a bottom side of the insulative housing and positioned under the insulative housing, the receiving portion has a bottom wall relative to the bottom side of the insulative housing, the distal end of the resilient arm having the latching block is provided to the bottom wall of the receiving portion.

In addition, preferably the positioning mechanism comprises the two latching blocks, the two latching blocks are offsettingly provided in a moving direction that the limiting element can be adjusted in the front-rear direction. Preferably, the abutting-retaining face of the limiting element is provided with a plurality of abutting-retaining teeth continuously arranged. Preferably, the plurality of abutting-retaining teeth are presented as a wavy shape. Preferably, each of the plurality of terminals has a contact portion, a fixed portion connected to the contact portion and fixedly provided in the insulative housing, and a connection portion extending out of the mounting face from the fixed portion; and the connection portion is a press-fit type or a needle-eye shape. Preferably, the insulative housing comprises a front housing and a rear housing engaged with the front housing, and the front housing is provided with a plurality of terminal grooves respectively correspondingly receiving the plurality of terminals, a front segment part of a bottom side of the front housing is integrally connected to the receiving portion, a part of the bottom side of the front housing behind the receiving portion forms the mounting face. Preferably, each of the plurality of terminals is formed by two plates engaged with each other, the two plates are respectively provided with at least a set of a protruding block and a latching hole engaged with each other and are respectively provided with fixing wings protruding outwardly, the fixing wing is positioned at the fixed portion and is interferentially fitted with an inner wall of the front housing adjacent the terminal groove.

An embodiment of the present application further provides an electrical connection device, which is mounted to a circuit board. The electrical connection device comprises: an electrical connector comprising an electrical connector comprising an insulative housing, a plurality of terminals provided to the insulative housing, and a mounting face positioned at a bottom side thereof, the mounting face is mounted to an upper board surface of the circuit board; a receiving portion provided to the bottom side of the electrical connector and positioned in front of the mounting face and having a receiving groove extending in a front-rear direction; and a limiting element provided through the receiving groove and positioned in the receiving portion and having an abutting-retaining face inclined to the ground and facing the mounting face, at least a part of the abutting-retaining face protrudes out of a rear side of the receiving groove and is positioned under the mounting face so as to abut against a front edge of a lower board surface of the circuit board.

BRIEF DESCRIPTION OF THE DRAWINGS

The present invention is illustrated by way of example and not limited in the accompanying figures in which like reference numerals indicate similar elements and in which.

DETAILED DESCRIPTION OF THE PREFERRED EMBODIMENTS

The previous and other technical contents, characteristics, and effects of the present application will be apparent from the following detailed description of two preferred embodiments in combination with the drawings. The detailed description that follows describes exemplary embodiments and is not intended to be limited to the expressly disclosed combination(s).

In an embodiment the disclosure provides an electrical connection device having a limiting element of which a position may be adjusted according to circuit boards with different thickness specifications, so as to overcome a problem that a latch element of an electrical connector in prior art can be not mounted to the circuit boards with different thickness specifications, and so as to increase assembly strength of the electrical connector and the circuit board and retain stability of electrical connection. As can be appreciated, beneficial effects of the present application lie in that, the limiting element has the inclined abutting-retaining face, and the limiting element may be fine adjusted the position thereof in the front-rear direction so as to ensure that the abutting-retaining face can abut against the circuit board, so that the electrical connection device can be mounted to circuit boards with different thicknesses, and assembly strength of the electrical connector and the circuit board is increased and stability of electrical connection of the electrical connector and the circuit board is retained by the limiting element.

Figure 1:
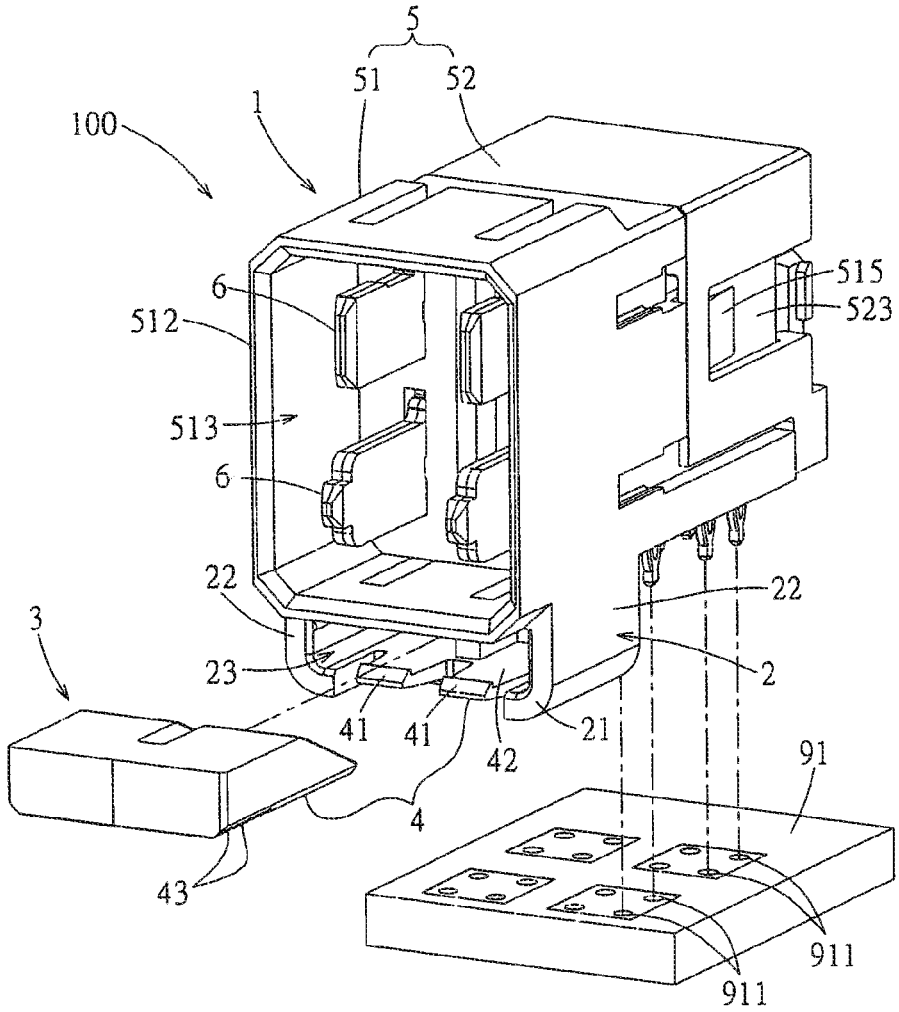
FIG. 1 is a perspective view illustrating a first preferred embodiment of an electrical connection device of the present application which is not mounted to a circuit board.
Figure 2:
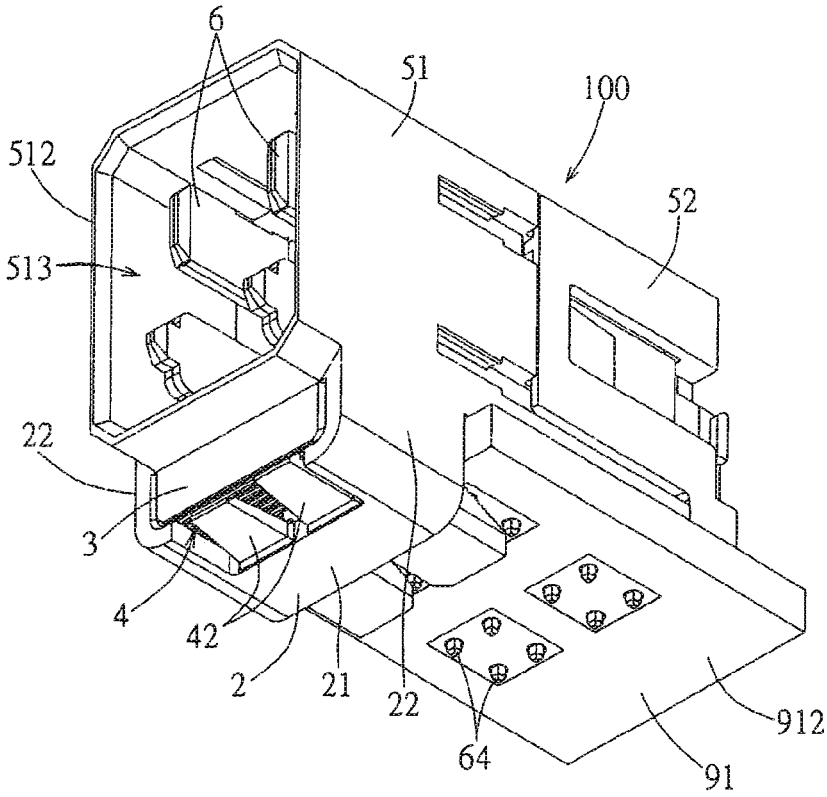
FIG. 2 is a perspective view illustrating the first preferred embodiment mounted to the circuit board.
Figure 3:
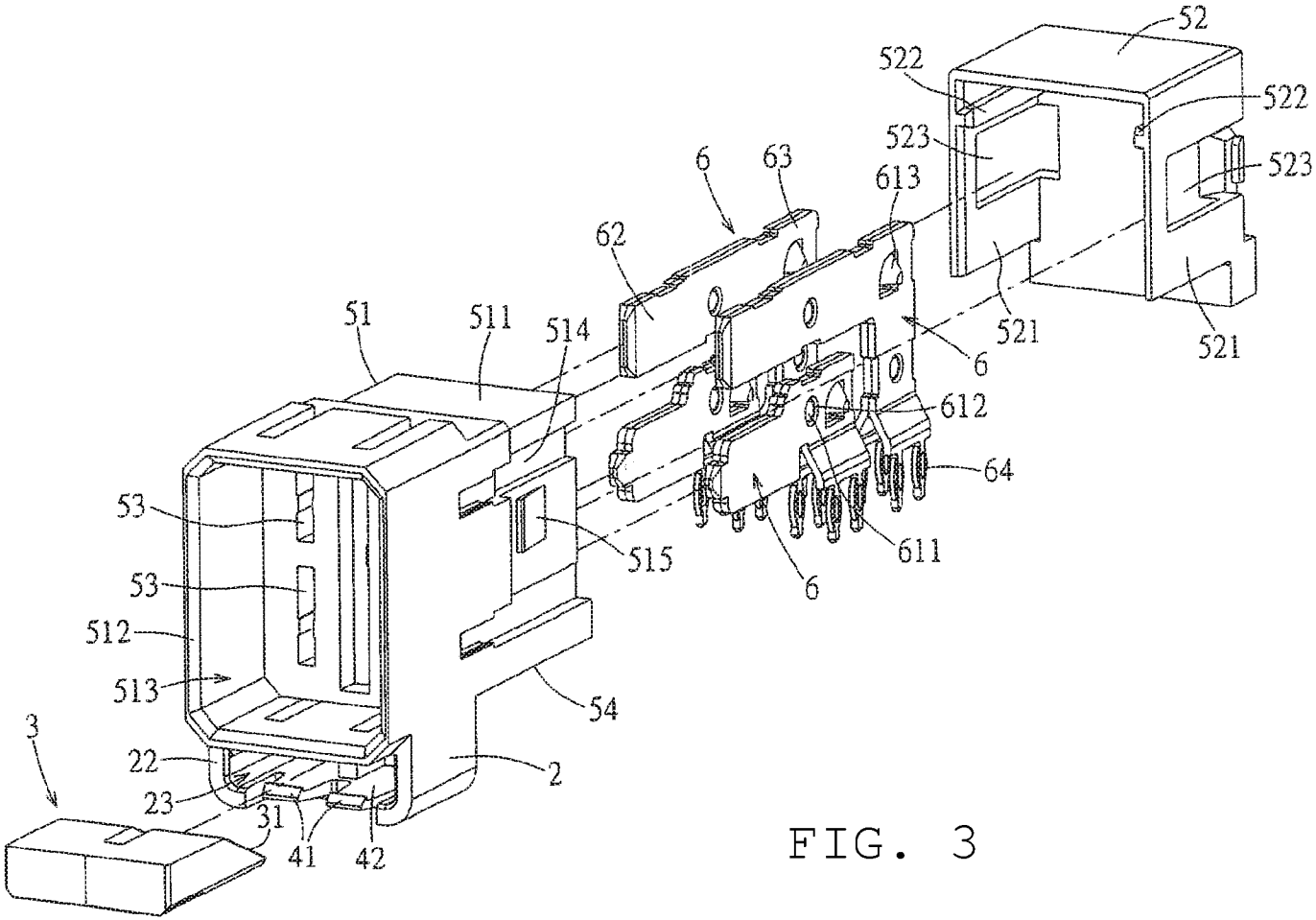
FIG. 3 is an exploded perspective view illustrating the first preferred embodiment.

Referring to FIGS. 1-3, an electrical connection device 100 of a first preferred embodiment of the present application is mounted to a circuit board 91, the electrical connection device 100 comprises an electrical connector 1, a receiving portion 2, a limiting element 3, and a positioning mechanism 4.

Figure 4:
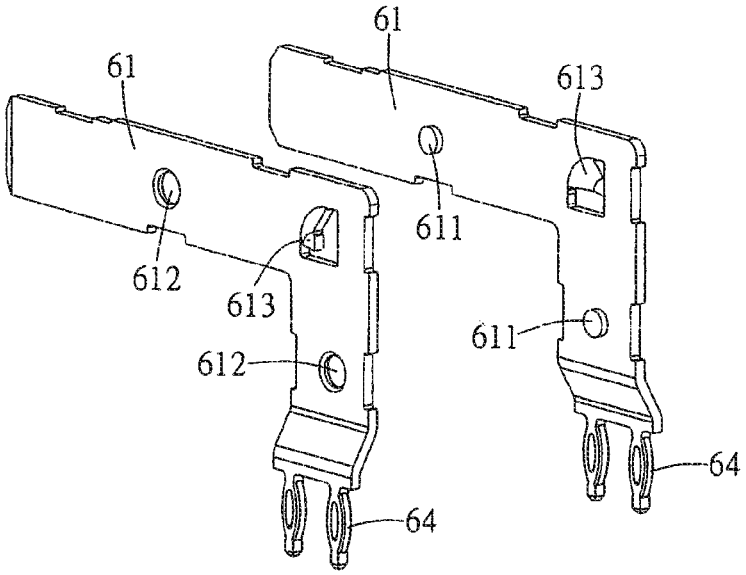
FIG. 4 is an exploded perspective view illustrating a terminal of the first preferred embodiment.
Figure 5:
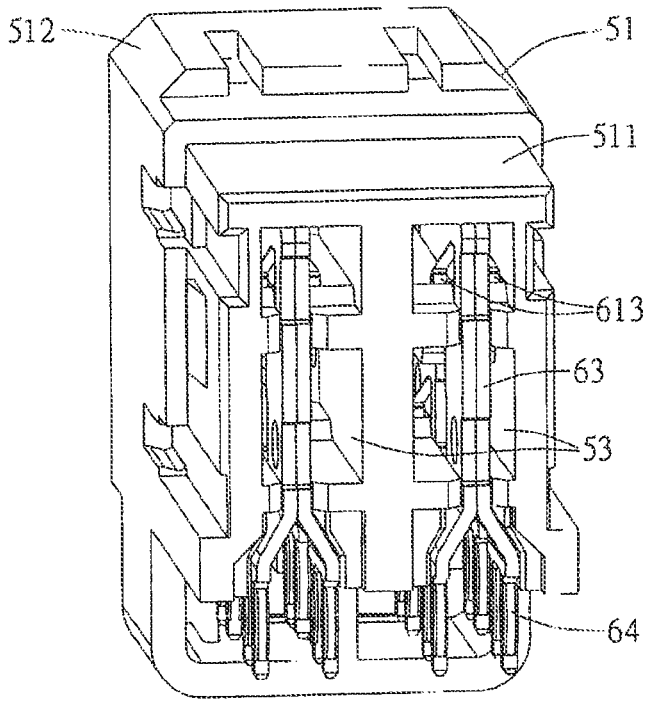
FIG. 5 is a perspective view illustrating the terminals of the first preferred embodiment which are mounted to a front housing of an insulative housing.

Referring to FIGS. 3-5, the electrical connector 1 comprises an insulative housing 5 and a plurality of terminal 6 provided to the insulative housing 5. The insulative housing 5 comprises a front housing 51 and a rear housing 52 engaged with the front housing 51, and the front housing 51 is provided with a plurality of terminal grooves 53 respectively correspondingly receiving terminals 6, a front segment part of a bottom side of the front housing 51 is integrally connected to the receiving portion 2, a part of the bottom side of the front housing 51 behind the receiving portion 2 forms a mounting face 54. The front housing 51 has a base portion 511 and an enclosing wall 512 connected to a front side of the base portion 511, and a mating chamber 513 opening forwardly is defined by the enclosing wall 512, each of the terminal grooves 53 penetrates the base portion 511 in a front-rear direction and is communicated with the mating chamber 513. Referring to FIG. 4, each of the terminals 6 is formed by two plates 61 mated with each other, the two plates 61 are respectively provided with at least a set of a protruding block 611 and a latching hole 612 which are mated with each other, and are respectively provided with fixing wings 613 protruding outwardly.

Figure 10:
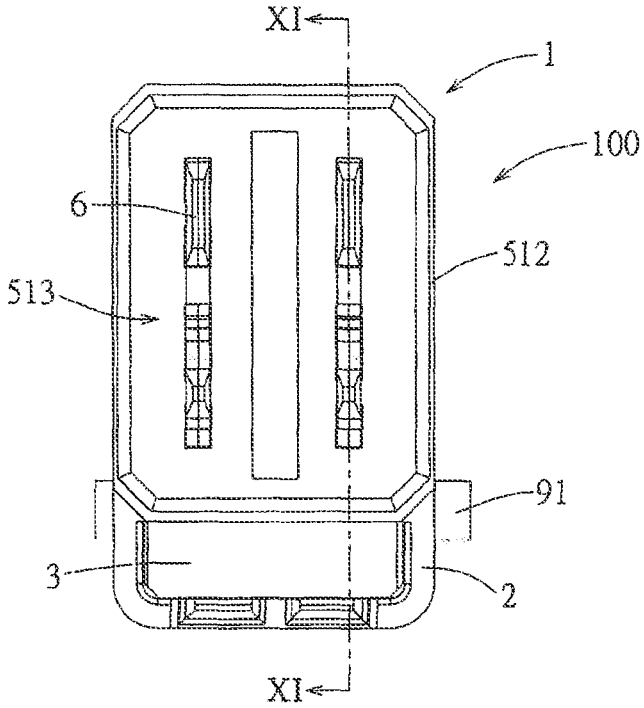
FIG. 10 is a front view of FIG. 2.
Figure 11:
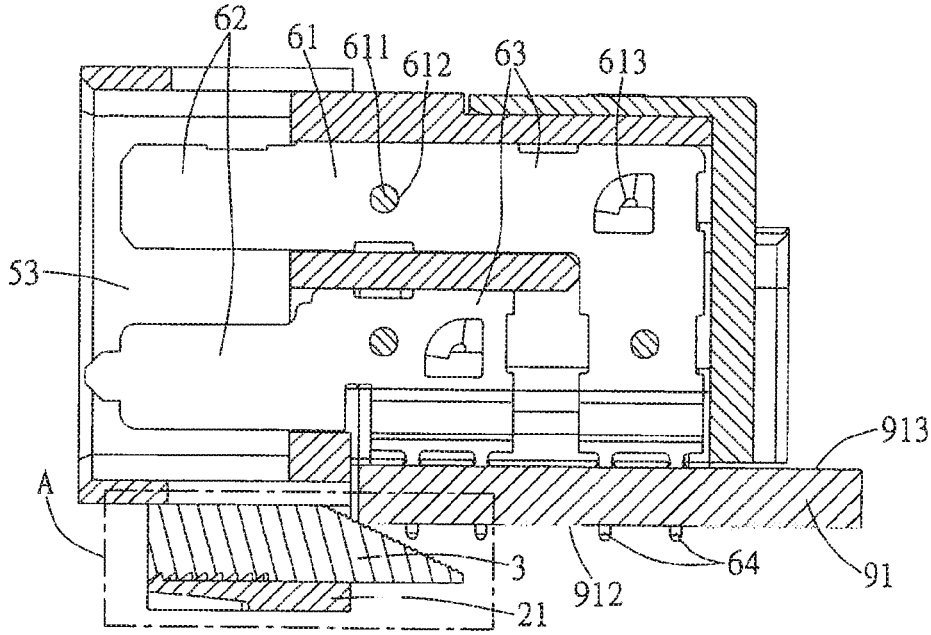
FIG. 11 is a cross sectional view taken along a XI-XI line of FIG. 10.

Referring to FIG. 3, in the present embodiment, the terminals 6 have two configurations, the two terminals 6 at a lower side are shorter in length and are provided with only one set of the protruding block 611 and the latching hole 612, the two terminals 6 at an upper side are longer in length and are provided with two sets of the protruding blocks 611 and the latching holes 612, a single terminal 6 is formed by engaging the two corresponding plates 61 with each other with engaging the protruding block(s) 611 and the latching hole(s) 612 with each other. Referring to FIG. 3 and FIG. 5 and in combination with FIG. 10 and FIG. 11, each of the terminals 6 has: a contact portion 62 extending into the mating chamber 513; a fixed portion 63 connected to the contact portion 62 and fixedly provided in the base portion 511 of the front housing 51; and a connection portion 64 extending out of the mounting face 54 from the fixed portion 63. The fixing wings 613 of the two plates 61 (i.e. positioned at the fixed portion 63) respectively protrude outwardly toward two sides. When the terminal 6 is inserted into the terminal groove 53 from a rear side of the terminal groove 53, bottom edge of the fixing wing 613 and an inner wall of the front housing 51 adjacent the terminal groove 53 are interferentially fitted. The connection portion 64 of the terminal 6 is a press-fit type, and specifically presented as a needle-eye shape, each of the connection portions 64 is formed by four pins with needle-eye shapes. The pins are respectively inserted into the connection holes 911 of the circuit board 91 (referring to FIG. 1 and FIG. 2) and are compressed by and contact with the connection holes 911 so as to establish an electrical connection with wiring track of the circuit board 91.

Referring to FIG. 1 and FIG. 3 again, the rear housing 52 and the front housing 51 are engaged with each other, inner sides of two side walls 521 of the rear housing 52 are provided with transversal protruding ribs 522 respectively, two sides of the base portion 511 of the front housing 51 are provided with transversal latching grooves 514 respectively, the protruding rib 522 and the latching groove 514 are engaged with each other, and may act as a guide rail. This can restrict the rear housing 52 from moving in an up-down direction relative to the front housing 51 when the front housing 51 is engaged with the rear housing 52. Furthermore, the two sides of the base portion 511 of the front housing 51 are further provided with stopping blocks 515 respectively, and the two side walls 521 of the rear housing 52 are correspondingly provided with through holes 523 respectively, so that a front side part of each of the side walls 521 adjacent through hole 523 can abut against the stopping block 515. In addition, a wall surface of the front housing 51 spaced apart a certain distance from a front side of the stopping block 515 is relatively expanded outwardly, so as to have the rear housing 52 abut against and consequently restrict the rear housing 52 to move in the front-rear direction relative to the front housing 51. After the terminals 6 are assembled to the front housing 51, the rear housing 52 and the front housing 51 are assembled and the rear sides of the terminal grooves 53 may be enclosed by the rear housing 52.

Figure 7:
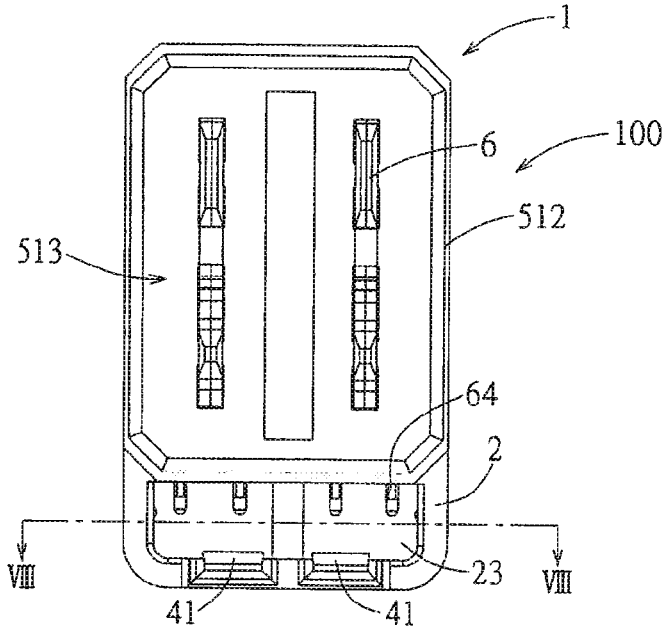
FIG. 7 is a front view illustrating the first preferred embodiment to which the limiting element is not mounted.

Referring to FIG. 1 and FIG. 2 and in combination with FIG. 7 and FIG. 9 again, as described above, the receiving portion 2 is integrally connected to the front segment part of the bottom side of the front housing 51, that is, the receiving portion 2 is provided to the bottom side of the electrical connector 1 and positioned in front of the mounting face 54. The receiving portion 2 has a bottom wall 21 relative to the bottom side of the insulative housing 5, two side walls 22 respectively extending from two sides of the bottom wall 21 and integrally connected to the insulative housing 5, and a receiving groove 23 defined by the bottom wall 21, the two side walls 22, and the bottom side of the insulative housing 5 together and extending in the front-rear direction. The receiving groove 23 is used for receiving the limiting element 3.

Referring to FIG. 2, FIG. 6 and FIGS. 9-12, the limiting element 3 is provided through the receiving groove 23 and positioned in the receiving portion 2, and has a abutting-retaining face 31 which is inclined relative to the ground and faces the mounting face 54, at least a part of the abutting-retaining face 31 protrudes out of a rear side of the receiving groove 23 and is positioned under the mounting face 54, so as to abut against a front edge of a lower board surface 912 of the circuit board 91. Herein, the limiting element 3 is positioned at the receiving portion 2 by the positioning mechanism 4. The positioning mechanism 4 is provided between the receiving portion 2 and the limiting element 3, so as to position the limiting element 3 at different positions in the front-rear direction. Specifically, the positioning mechanism 4 comprises a resilient arm 42 which is provided to the bottom wall 21 of the receiving portion 2 and at least a distal end of which is provided with a latching block 41 and a plurality of one-way latching teeth 43 which are provided to a bottom surface 32 of the limiting element 3 and are arranged continuously and the latching block 41 abuts against one of the latching teeth 43 so as to position the limiting element 3. In other words, as shown in a perspective direction of FIG. 12, a left side of the latching block 41 is an inclined surface, and a right side of the latching block 41 is a closely vertical surface, the latching tooth 43 and the latching block 41 are matched with each other in shape. When the limiting element 3 moves into the receiving groove 23 from a front side of the receiving groove 23 to a rear side of the receiving groove 23, the latching block 41 may resiliently move downwardly so as to allow the limiting element 3 to move toward the rear side of the receiving groove 23 because the latching block 41 is connected to the distal end of the resilient arm 42. When the latching block 41 enters into an area where the latching teeth 43 are present, a recessed zone between the two adjacent latching teeth 43 may receive the latching block 41. The latching block 41 returns upwardly to an original position by restoring force of the resilient arm 42 and is positioned between the adjacent latching teeth. When the limiting element 3 continuously moves rearwardly relative to the latching block 41, if the latching tooth 43 meets the latching block 41, both of them slip along the inclined surface relative to each other, and the latching tooth 43 pushes the latching block 41 downwardly so as to allow the limiting element 3 pass through. Thus the limiting element 3 will not be blocked by the latching block 41. However, if the limiting element 3 moves in an opposite direction, a vertical surface of the latching tooth 43 would abut against the vertical surface of the latching block 41 and the latching tooth 43 is blocked by the latching block 41, so that the limiting element 3 can not move. Therefore, the limiting element 3 only can one-way move in the receiving portion 2. If a position of the limiting element 3 is re-adjusted or the electrical connection connector 1 is replaced, the limiting element 3 can be removed by pressing the latching block 41 downwardly with external force or a tool.

Figure 8:
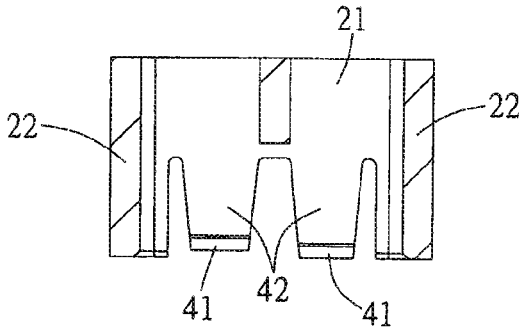
FIG. 8 is a cross sectional view taken along a VIII-VIII line of FIG. 7 illustrating that two latching blocks of the first preferred embodiment are offsettingly provided.
Figure 12:
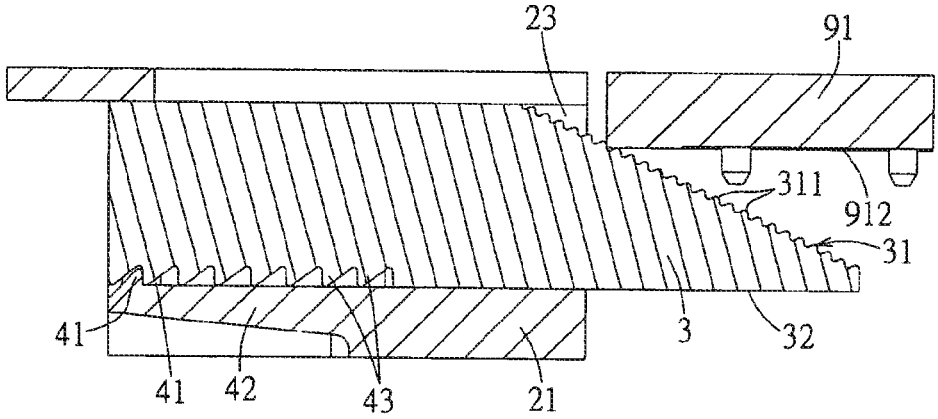
FIG. 12 is an enlarged view of a partial region A of FIG. 11.

Furthermore, referring to FIG. 7, FIG. 8, and FIG. 12, in order to be able to fine adjust the position of the limiting element 3, in the present embodiment, the positioning mechanism 4 comprises the two resilient arms 42, lengths of the two resilient arms 42 differ a short distance with each other (as shown in FIG. 8), the distance is one half of a pitch between the two adjacent latching teeth 43, so that the two latching blocks 41 respectively provided to the distal ends of the two resilient arms 42 are provided offsettingly in a moving direction that the limiting element 3 may be adjusted in the front-rear direction, and a offsetting distance between the two latching blocks 41 is one half of the pitch between the two adjacent latching teeth 43, and the limiting element 3 is positioned by abutment between one of the latching blocks 41 and one of the latching teeth 43, consequently, a moving amplitude adjusting the limiting element 3 may be reduced to one half of the pitch of the latching teeth 43, or the offsetting distance between the two latching blocks 41 may allow to clamp one latching tooth 43 in the front-rear direction, thereby increasing positioning strength.

Figure 6:
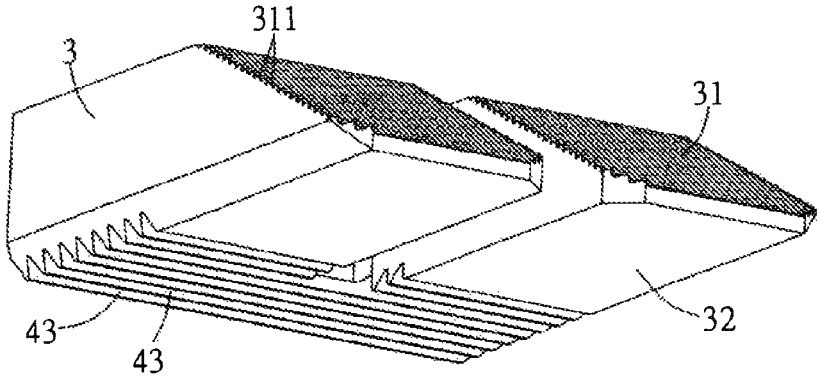
FIG. 6 is a perspective view illustrating a limiting element of the first preferred embodiment.
Figure 9:
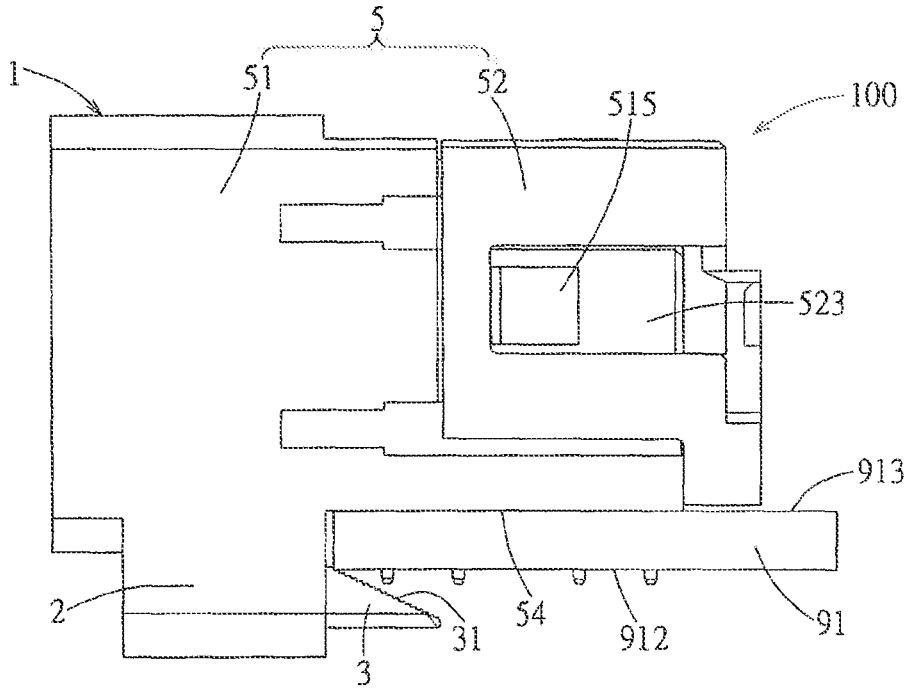
FIG. 9 is a side view of FIG. 2.

Referring to FIG. 6 and FIG. 12 again, the abutting-retaining face 31 of the limiting element 3 is provided with a plurality of abutting-retaining teeth 311 continuously arranged, the plurality of abutting-retaining teeth 311 are presented as a wavy shape, after the electrical connector 1 is mounted to the circuit board 91, the limiting element 3 is inserted into the receiving groove 23 toward the rear side from the front side of the receiving groove 23, the limiting element 3 is moved rearwardly until the abutting-retaining face 31 of the limiting element 3 abuts against and contacts the front edge of the lower board surface 912 of the circuit board 91. As can be known from above, the limiting element 3 can only one-way move, when the abutting-retaining face 31 of the limiting element 3 abuts against and contacts the circuit board 91, the limiting element 3 can not further move rearwardly, and is positioned by the positioning mechanism 4 and can not move reversely, so that the limiting element 3 is positioned at the receiving portion 2. Moreover, an abutting force of the limiting element 3 on the circuit board 91 may be increased by the abutting-retaining teeth 311 in the abutting-retaining face 31, so that the abutting-retaining face 31 less easily slips relative to the circuit board 91. As shown in FIG. 9, the circuit board 91 is clamped between the mounting face 54 of the insulative housing 5 and the abutting-retaining face 31 of the limiting element 3, that is, the mounting face 54 is mounted on the upper board surface 913 of the circuit board 91 and the abutting-retaining face 31 abuts against the lower board surface 912 of the circuit board 91, consequently, when a mating connector (not shown) is mated with the mating chamber 513 from a front side of the electrical connector 1 or is pulled out from the mating chamber 513, the electrical connector 1 may be easily subject to an upward force, the upward force may be cancelled by that the limiting element 3 abuts against the lower board surface 912 of the circuit board 91, thereby increasing the stability of the electrical connection between the electrical connector 1 and the circuit board 91.

Furthermore, because the abutting-retaining face 31 of the limiting element 3 is an inclined surface relative to the mounting face 54 (i.e. relative to the circuit board 91), when the electrical connection device 100 is mounted to a circuit board with a different thickness, the position of the limiting element 3 may be adjusted in the front-rear direction, so that the electrical connection device 100 is matched with the circuit board with the different thickness specification.

Figure 13:
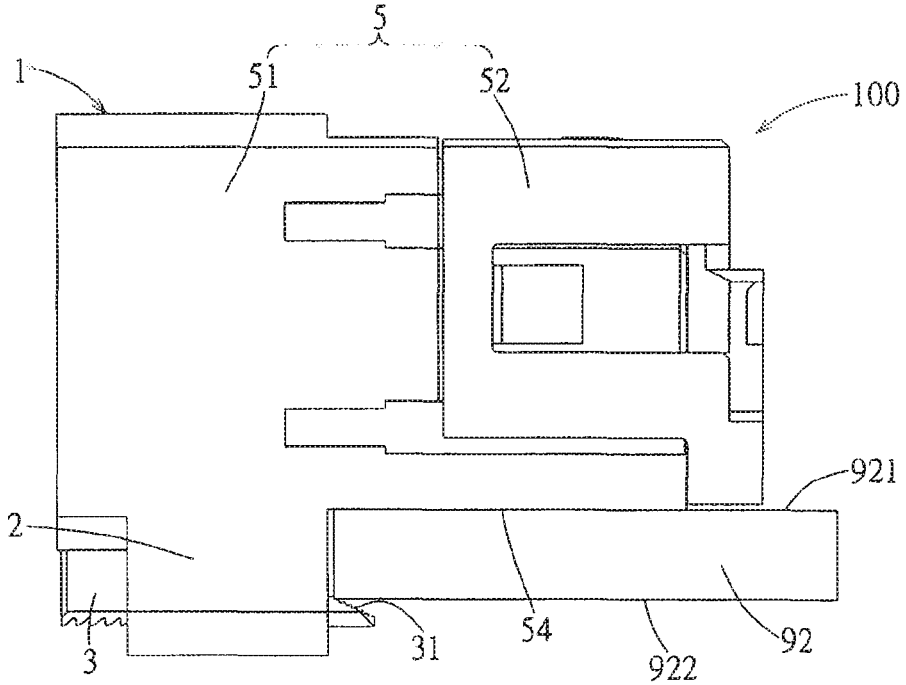
FIG. 13 is a side view similar to FIG. 9 illustrating a second preferred embodiment of an electrical connection device of the present application.
Figure 14:
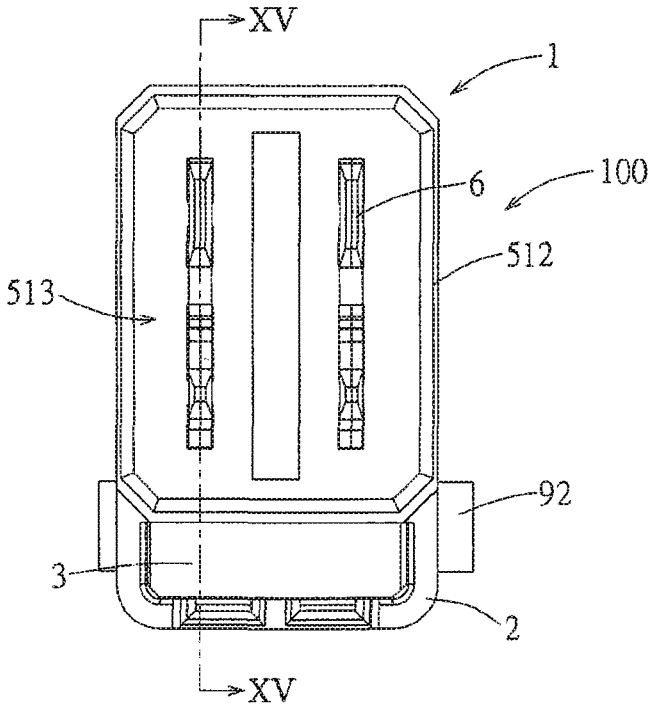
FIG. 14 is a front view of FIG. 13.
Figure 15:
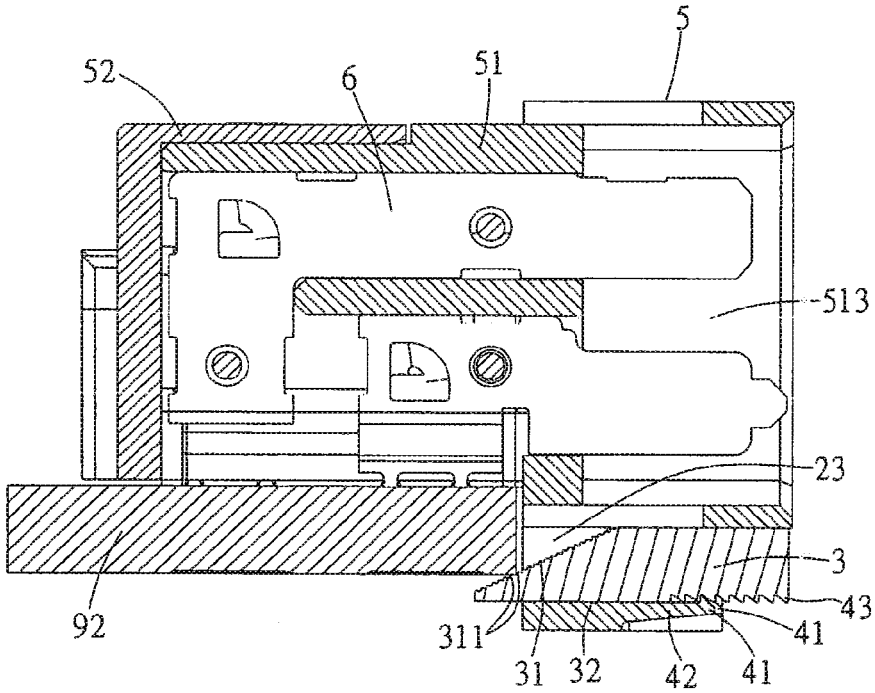
FIG. 15 is a cross sectional view taken along a XV-XV line of FIG. 14.

For example, referring to FIGS. 13-15, a second preferred embodiment of an electrical connection device of the present application is illustrated. In comparison with the first preferred embodiment, in the second preferred embodiment, the mounting face 54 of the electrical connection device 100 is mounted on the upper board surface 921 of the circuit board 92 with a larger thickness, therefore, a part of the abutting-retaining face 31 of the limiting element 3 extending rearwardly out of the receiving groove 23 is less, so that the lower board surface 922 of the circuit board 92 abuts against the abutting-retaining tooth 311 closer to a side of the bottom surface 32 of the limiting element 3 (at a lower position). That is to say, when the circuit board 91 is thinner, a part of the abutting-retaining face 31 of the limiting element 3 extending rearwardly out of the receiving groove 23 may be more, so that the circuit board 91 abuts against the abutting-retaining tooth 311 of the abutting-retaining face 31 at an upper position; when the circuit board 92 is thicker, a part of the abutting-retaining face 31 of the limiting element 3 extending rearwardly out of the receiving groove 23 is less, so that the circuit board 92 abuts against the abutting-retaining tooth 311 of the abutting-retaining face 31 at a lower position. Moreover, the position of the limiting element 3 can be fine adjusted and the limiting element 3 can be positioned at different positions in the front-rear direction by the abutting-retaining face 31 which is a continuous inclined surface and the positioning mechanism 4, circuit boards in a certain thickness range can abut against the abutting-retaining face 31 by adjusting the position of the limiting element 3 in the front-rear direction, so that the electrical connection device 100 can be suitable for various circuit boards with different thickness specifications.

In conclusion, the position of the limiting element 3 can be fine adjusted in the front-rear direction by the limiting element 3 which has the inclined abutting-retaining face 31 and the positioning mechanism 4, it can be ensured that the abutting-retaining face 31 can abut against the circuit board 91/92, so that the electrical connection device 100 can be mounted to the circuit board 91/92 with different thickness, and assemble strength between the electrical connector 1 and the circuit board 91/92 is increased by the limiting element 3 so that the electrical connector 1 may less easily oscillated relative to the circuit board 91, 92 and stability of the electrical connection may be retained.

The disclosure provided herein describes features in terms of preferred and exemplary embodiments thereof. Numerous other embodiments, modifications and variations within the scope and spirit of the appended claims will occur to persons of ordinary skill in the art from a review of this disclosure.

What is claimed is:

1. An electrical connection device, comprising:

an electrical connector comprising an insulative housing, a plurality of terminals provided to the insulative housing, and a mounting face positioned at a bottom side thereof;

a receiving portion provided to the bottom side of the electrical connector and positioned in front of the mounting face and having a receiving groove extending in a front-rear direction; and a limiting element provided through the receiving groove and positioned in the receiving portion and having an abutting-retaining face inclined to the ground and facing the mounting face, at least a part of the abutting-retaining face protrudes out of a rear side of the receiving groove and being positioned under the mounting face.

2. The electrical connection device according to claim 1, wherein the electrical connection device further comprises a positioning mechanism provided between the receiving portion and the limiting element for positioning the limiting element at different positions in the front-rear direction.

3. The electrical connection device according to claim 2, wherein the positioning mechanism comprises at least a latching block provided to the receiving portion and a plurality of one-way latching teeth provided to the limiting element and continuously arranged, the latching block abuts against one of the latching teeth so as to position the limiting element.

4. The electrical connection device according to claim 3, wherein the latching teeth are provided to a bottom surface of the limiting element, and the positioning mechanism further comprising at least a resilient arm provided to the receiving portion, a distal end of each of the resilient arms is provided with a latching block.

5. The electrical connection device according to claim 4, wherein the receiving portion is integrally connected to a bottom side of the insulative housing and positioned under the insulative housing, the receiving portion has a bottom wall relative to the bottom side of the insulative housing, the distal end of the resilient arm having the latching block is provided to the bottom wall of the receiving portion.

6. The electrical connection device according to claim 5, wherein the positioning mechanism comprises the two latching blocks, the two latching blocks are offsettingly provided in a moving direction that the limiting element can be adjusted in the front-rear direction.

7. The electrical connection device according to claim 6, wherein the abutting-retaining face of the limiting element is provided with a plurality of abutting-retaining teeth continuously arranged.

8. The electrical connection device according to claim 7, wherein the plurality of abutting-retaining teeth are presented as a wavy shape.

9. The electrical connection device according to claim 7, wherein each of the plurality of terminals has a contact portion, a fixed portion connected to the contact portion and fixedly provided in the insulative housing, and a connection portion extending out of the mounting face from the fixed portion; and the connection portion is a press-fit type or a needle-eye shape.

10. The electrical connection device according to claim 9, wherein the insulative housing comprises a front housing and a rear housing engaged with the front housing, and the front housing is provided with a plurality of terminal grooves respectively correspondingly receiving the plurality of terminals, a front segment part of a bottom side of the front housing is integrally connected to the receiving portion, a part of the bottom side of the front housing behind the receiving portion forms the mounting face.

11. The electrical connection device according to claim 10, wherein each of the plurality of terminals is formed by two plates engaged with each other, the two plates are respectively provided with at least a set of a protruding block and a latching hole engaged with each other and are respectively provided with fixing wings protruding outwardly, the fixing wing is positioned at the fixed portion and is interferentially fitted with an inner wall of the front housing adjacent the terminal groove.

12. An electrical connection device, mounted to a circuit board, the electrical connection device comprising:

an electrical connector comprising:

an electrical connector comprising an insulative housing, a plurality of terminals provided to the insulative housing, and a mounting face positioned at a bottom side thereof, the mounting face being mounted to an upper board surface of the circuit board;

a receiving portion provided to the bottom side of the electrical connector and positioned in front of the mounting face and having a receiving groove extending in a front-rear direction; and a limiting element provided through the receiving groove and positioned in the receiving portion and having an abutting-retaining face inclined to the ground and facing the mounting face, at least a part of the abutting-retaining face protrudes out of a rear side of the receiving groove and being positioned under the mounting face so as to abut against a front edge of a lower board surface of the circuit board.

13. The electrical connection device according to claim 12, wherein the electrical connection device further comprises a positioning mechanism provided between the receiving portion and the limiting element for positioning the limiting element at different positions in the front-rear direction.

14. The electrical connection device according to claim 13, wherein the positioning mechanism comprises at least a latching block provided to the receiving portion and a plurality of one-way latching teeth provided to the limiting element and continuously arranged, the latching block abuts against one of the latching teeth so as to position the limiting element.

15. The electrical connection device according to claim 14, wherein the latching teeth are provided to a bottom surface of the limiting element, and the positioning mechanism further comprising at least a resilient arm provided to the receiving portion, a distal end of each of the resilient arms is provided with a latching block.

16. The electrical connection device according to claim 15, wherein the receiving portion is integrally connected to a bottom side of the insulative housing and positioned under the insulative housing, the receiving portion has a bottom wall relative to the bottom side of the insulative housing, the distal end of the resilient arm having the latching block is provided to the bottom wall of the receiving portion.

17. The electrical connection device according to claim 16, wherein the positioning mechanism comprises the two latching blocks, the two latching blocks are offsettingly provided in a moving direction that the limiting element can be adjusted in the front-rear direction.

18. The electrical connection device according to claim 17, wherein the abutting-retaining face of the limiting element is provided with a plurality of abutting-retaining teeth continuously arranged.

19. The electrical connection device according to claim 18, wherein the plurality of abutting-retaining teeth are presented as a wavy shape.

20. The electrical connection device according to claim 18, wherein each of the plurality of terminals has a contact portion, a fixed portion connected to the contact portion and fixedly provided in the insulative housing, and a connection portion extending out of the mounting face from the fixed portion; and the connection portion is a press-fit type or a needle-eye shape.

21. The electrical connection device according to claim 20, wherein the insulative housing comprises a front housing and a rear housing engaged with the front housing, and the front housing is provided with a plurality of terminal grooves respectively correspondingly receiving the plurality of terminals, a front segment part of a bottom side of the front housing is integrally connected to the receiving portion, a part of the bottom side of the front housing behind the receiving portion forms the mounting face.

22. The electrical connection device according to claim 21, wherein each of the plurality of terminals is formed by two plates engaged with each other, the two plates are respectively provided with at least a set of a protruding block and a latching hole engaged with each other and are respectively provided with fixing wings protruding outwardly, the fixing wing is positioned at the fixed portion and is interferentially fitted with an inner wall of the front housing adjacent the terminal groove.

* * * * *